US005884636A

United States Patent [19]

Sheffler et al.

[11] Patent Number: 5,884,636

[45] Date of Patent: Mar. 23, 1999

[54] COSMETIC POT WITH INTERNAL HINGED TRAY

[75] Inventors: Robert J. Sheffler, Morganville, N.J.; Charles Chang, 55 Westview Rd., Wayne, N.J. 07470

[73] Assignee: Charles Chang, Wayne, N.J.

[21] Appl. No.: 924,984

[22] Filed: Sep. 8, 1997

[51] Int. Cl.[6] ..... A45D 33/24

[52] U.S. Cl. ..... 132/295; 132/300; 220/DIG. 26

[58] Field of Search ..... 132/295, 296, 132/301, 304, 305, 293, 294; 206/581, 823; 220/DIG. 26

[56] References Cited

U.S. PATENT DOCUMENTS

| | | | |
|---|---|---|---|
| 1,456,636 | 5/1923 | Kendall | 132/296 |
| 1,651,193 | 11/1927 | Chisholm | 132/305 |
| 2,401,127 | 5/1946 | Younghusband | 132/293 |
| 3,911,936 | 10/1975 | Kingsford | 132/301 |
| 4,972,860 | 11/1990 | Yuhara et al. | 132/293 |
| 5,542,561 | 8/1996 | Slink et al. | 132/293 |

FOREIGN PATENT DOCUMENTS

| | | | |
|---|---|---|---|
| 580512 | 1/1994 | European Pat. Off. | 132/293 |
| 2414311 | 9/1979 | France | 132/293 |
| 2522943 | 9/1983 | France | 206/823 |
| 2539968 | 8/1984 | France | 132/293 |
| 406181821 | 7/1994 | Japan | 132/293 |
| 2137594 | 10/1984 | United Kingdom | 206/823 |

*Primary Examiner*—Todd E. Manahan

*Attorney, Agent, or Firm*—H. Gibner Lehmann; K. Gibner Lehmann

[57] ABSTRACT

A display-type applicator-containing compact for cosmetics and the like, comprises a shallow jar having a wide neck portion with external screw threads, and a ring-shaped screw cap member that is mounted on and cooperable with the neck portion. The neck portion has an annular sealing lip, and a plastic lens member is disposed in the screw cap member to provide an underside sealing area that engages the sealing lip. A swivel-mounted tray adapted to hold cosmetic material is pivotally mounted in the jar in spaced relation to the jar bottom, providing sufficient space under the tray to store a puff or similar applicator. The underside of the tray is a mirror, for use when the tray is swung up out of the jar, and when the applicator is being used.

18 Claims, 4 Drawing Sheets

COSMETIC POT WITH INTERNAL HINGED TRAY

CROSS REFERENCES TO RELATED APPLICATIONS

1. Co-pending application U.S. Ser. No. 08/558,811, filed Nov. 15, 1995, entitled COSMETIC JAR AND STORAGE DEVICE, and having common ownership with the present application.

2. Co-pending application U. S. Ser. No. 08/620,221, filed Mar. 22, 1996, entitled COSMETIC JAR AND STORAGE DEVICE, and having common ownership with the present application.

3. Co-pending application U. S. Ser. No. 08/677,342 filed Jul. 2, 1996, entitled COSMETIC JAR and having common ownership with the present application.

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

FIELD OF THE INVENTION

This invention relates generally to plastic jars, and more particularly to jars of the type commonly used to contain and dispense colored cosmetic materials, or substances of a type where a hermetic seal is required in order to preserve or protect the efficacy of the contained material or substance and the dispensing media which could be a puff, sponge or foam.

DESCRIPTION OF THE RELATED ART INCLUDING INFORMATION DISCLOSED UNDER 37 CFR §§1.97–1.99

The following references are hereby made of record, as being of interest in the technical field of the invention:

| U.S. Patents Nos.: | | |
|---|---|---|
| 209,813 | 326,492 | 597,083 |
| 748,642 | 893,008 | 997,505 |
| 1,516,129 | 1,700,958 | 3,428,208 |
| 3,111,237 | 3,428,208 | 4,834,824 |

Considering the references chronologically, U.S. Pat. No. 209,813 discloses a container having a lip provided with an annular external groove, and a gasket or packing received in the groove. The container's cover has a depending annular ring which fits into the groove and engages the packing to form a seal of the contents.

U.S. Pat. No. 326,492 involves a jar having a lip with an annular recess, and a closure cap having a circular, downwardly extending edge. A rubber band is fitted into the recess. The edge of the cap, when assembled to the jar, compresses the band against the walls of the recess so as to form a seal.

U.S. Pat. No. 597,083 shows a container having a lip with an upwardly-facing annular recess, and a two-part cover comprising a metallic shell and a liner. The latter has a downwardly-facing recess adapted to overlie the lip recess.

A gasket is disposed in the container lip recess, and experiences compression when the cover is assembled to the container.

U.S. Pat. No. 748,642 relates to a jar and closure therefor, the jar having an upwardly-facing annular groove, and the underside of the closure having a peripheral, depending bead. A sealing gasket is engaged by the bead and forced into the groove, so as to establish a seal between the closure and jar.

U.S. Pat. No. 893,008 relates to a bottle and stopper member, wherein the bottle has an annular groove at its mouth, cooperable with a rib on the underside of the stopper member. Interposed between the latter and lip is a gasket constituted of paper or cork.

U.S. Pat. No. 997,505 illustrates a somewhat different arrangement, wherein an annular groove is provided in a closure cap for a bottle, and the wall of the neck of the bottle has a tapered or pointed cross-sectional configuration, arranged to engage and deform a sealing gasket located between the groove walls and the tapered wall of the bottle neck when the cap is assembled thereto.

U.S. Pat. No. 1,516,129 illustrates a construction similar to those of several of the previous patents, namely a jar having a lip with an upwardly-facing annular groove, and a sealing gasket placed in the groove. The cover has a depending outer wall receivable in the groove, so as to compress the gasket and seal the jar.

U.S. Pat. No. 1,700,958 also discloses a sealed container utilizing a gasket, and a depending circular flange on a cover for the container, the flange engaging the gasket when the cover is assembled.

U.S. Pat. No. 3,111,237 discloses a molded sealing gasket constituted of plastisol, deposited in a molten state, in a groove of a foil that is ultimately used as a liner on the underside of a cap. FIGS. 10 and 13 illustrate the general idea.

U.S. Pat. No. 3,428,208 involves a somewhat different concept, namely that of providing a variety of interengaging surfaces between a container and cover therefor, without the use of a gasket.

U.S. Pat. No. 4,834,824 illustrates a method of forming a gasket of predetermined outline by deposition of molten elastomer on a flat surface of a release board assembly. The latter is subsequently utilized to transfer the formed gasket to a workpiece. The arrangement has application in securing automotive windows in position and with the sealant disposed between the respective window and window frame member.

It is considered that few, if any, of the above-identified container arrangements have had significant impact in the marketplace, and accordingly there has existed a long-felt need for an improved container construction which could be successfully employed to store and dispense a wide variety of sensitive cosmetic preparations, such as skin creams, blushers, mascaras, eyeliners, eyeshadows, and/or lipsticks and lip liners. The use of conventional compressed paperboard, or foamed plastic or multi-composition laminated sealing sheets between the lip of a container and the underside of a closure therefor, has been found to be unacceptable in many cases, especially where the required seal area is large, as for example, the entire circular undersurface of the closure.

Also, sealing liners which were merely pressed into the closure of a container were unsuited for applications where the contents of the container were intended to be viewed, while the container was still in an unopened or sealed condition.

SUMMARY OF THE INVENTION

The above disadvantages and drawbacks of prior cosmetic-type containers are largely obviated by the present invention which has for one object to provide a novel and improved display-type applicator-containing compact which is simple in its structure and which features a novel, essentially completely air-tight or hermetic seal of the sensitive container contents, so as to avoid inadvertent evaporation or contamination thereof.

It is also an object of this invention to prevent dry-out or solvent loss from the applicator as well as the product, by storing it within the air-tight plenum. Dry-out of product that clings to the applicator would render it gritty, preventing deposition of a smooth surface on the face or body.

Another object of the invention is to provide an improved display-type applicator-containing compact as above indicated, which effectively isolates the container contents from the area around the cooperable screw threads on the container jar and closure therefor, thereby minimizing any tendency for product to accumulate or collect, and thereafter harden. Such a condition is not only unsightly, but also can interfere with smooth opening and closing of the container in the event of a residue build-up on or near the threads.

A further feature of this invention constitutes a completely contained hinged platform which separates the air-tight chamber into two horizontal sectors, one containing product and the other housing the applicator. This hinged platform is constructed to lift up to permit access to the bottom chamber and serve as a means for providing a mirrored reflecting surface on the underneath plane of the hinged platform.

A related object of the invention is to provide an improved display-type applicator-containing container as above characterized, which is largely resistant to chemical attack as from the contents, by virtue of the elimination of cap liners, laminates, and the like which do not tolerate well, organic-solvent-base compositions of a type that are currently being utilized in the cosmetic field.

Still another object of the invention is to provide an improved display-type applicator-containing container of the kind indicated, which permits the contents to readily viewed from outside the container closure, as through a transparent plastic window or lens, while at the same time completely concealing cooperable thread formations on the container neck and closure, which would otherwise be visible and detract from the overall appearance of the container. Such a consideration is important from the aesthetic, commercial and marketability standpoint, especially in today's consumer-oriented environment.

Yet another object of the invention is to provide an improved display-type applicator-containing container as above set forth, wherein the individual components can be readily molded in simple mold cavities, and at reduced manufacturing/assembly cost.

A still further object of the invention is to provide an improved display-type applicator-containing container in accordance with the foregoing, which can be easily held in the hand and manipulated, thereby rendering the device user-friendly.

Yet a further object of the invention is to provide an improved display-type applicator-containing container of the type noted, which is aesthetically pleasing and eye-catching in its overall appearance, this further enhancing the marketability of the item.

In accomplishing the above objects the invention provides a display-type applicator-containing container for cosmetics and the like, comprising in combination, a shallow two-piece jar having a wide annular neck portion provided with an external screw thread, the neck portion having a rim constituting a continuous sealing lip, and a shallow, cup-shaped screw cap member that is carried on and cooperable with the said neck portion.

The screw cap member has an internal screw thread that engages the external screw thread of the two-piece jar neck component. In addition, there is provided a plastic liner member disposed in the cup-shaped screw cap, such liner member having on its underside designated sealing areas which are engaged with the sealing lip of the neck portion. Peripheral portions of the cup-shaped screw-cap member are disposed in underlying relation with peripheral portions of the transparent liner member. Sealing means are provided, involving sealing areas of the liner member to maintain the same into tight sealing engagement with the continuous sealing lip of the jar.

Where the liner member is constituted of transparent plastic material, it can assume the function of a window or lens, enabling the cosmetic contents of the jar to be readily viewed prior to opening. Also, in a preferred form of the invention the screw cap member is constituted of opaque plastic material, which permits a complete concealment of its own screw thread as well as that of the jar.

By establishing the sealing function between the cup-shaped cover member and the liner member of the closure on the one hand, and between the closure member and the two-piece jar on the other hand, no external product leakage nor product leakage into the area of the threads occurs. There is thus eliminated the need for the usual cap liners or expensive sheet-type gaskets and the like, as typically were required in many prior container designs.

The arrangement is such that the liner member, when constituted of transparent material and functioning as a lens or window, at the same time serves as a functional component of the sealing mechanism, which latter is remote with respect to the location of the closure thread and jar thread.

Other features and advantages will hereinafter appear.

BRIEF DESCRIPTION OF THE DRAWINGS

In the drawings, illustrating several embodiments of the invention:

FIG. 6 is an axial sectional view of the closure cap part of the pot.

FIG. 7 is a top plan view of the closure cap part of the pot.

DESCRIPTION OF THE PREFERRED EMBODIMENT

Figure 1:
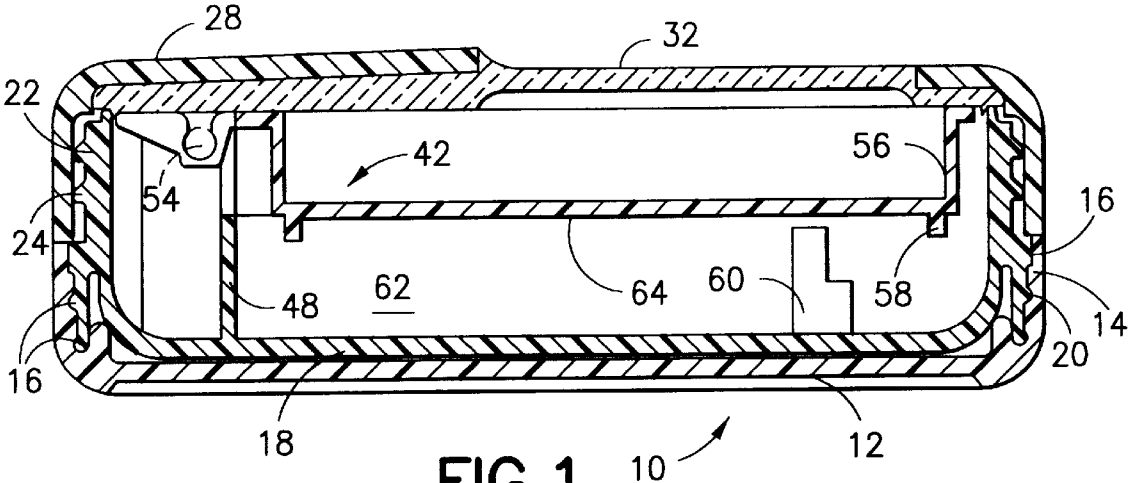
FIG. 1 is an axial section of the improved display-type applicator-containing pot of the present invention, comprising basically a composite jar and closure therefor.
Figure 2:
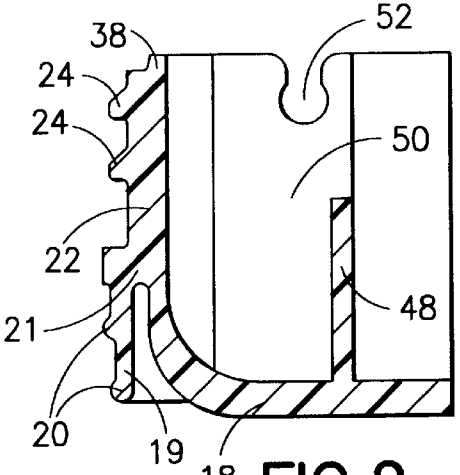
FIG. 2 is a fragmentary section, greatly enlarged, of the peripheral portion of the inner component of the container of FIG. 1.

Referring first to FIGS. 1 and 2 there is illustrated a composite or two-part container for cosmetics or other material, designated generally by the numeral 10 and comprising essentially a shallow outer jacket having a bottom wall 12 and an annular side wall 14, which latter forms a wide neck portion that, in accordance with the invention, is provided with a plurality of annular internal grooves 16. Also, in accordance with the present invention there is provided a novel yieldable plastic inner jar component or liner 18, preferably made of a polyolefin, that has connected to it midway up on its lower peripheral portion a depending resilient skirt 19 (FIG. 2) provided with a plurality of outer annular ribs 20 which can fit snugly in the grooves 16 of the wall 14 by a snap fit, to lock the liner 18 into the outer or jacket component 12. The skirt 19 is connected to the liner 18 by a web 21, which gives added flexibility and resilience to the skirt and enables the desired press-fit into the jacket wall 14 to be readily effected, and this is an important feature of the invention.

The liner 18 has an upstanding annular wall 22 that is provided with external screw threads 24 for cooperation with mating internal threads 26 of a shallow, cup-shaped screw cap 28, FIGS. 1 and 5–7. The lower container assemblage 10 can thus be tightly closed by the screw cap 28, as shown in FIG. 1.

Figure 9:
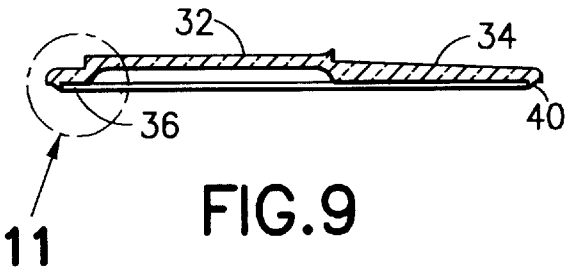
FIG. 9 is a diametric section of the lens or lid window of the closure cap part of the pot.
Figure 10:
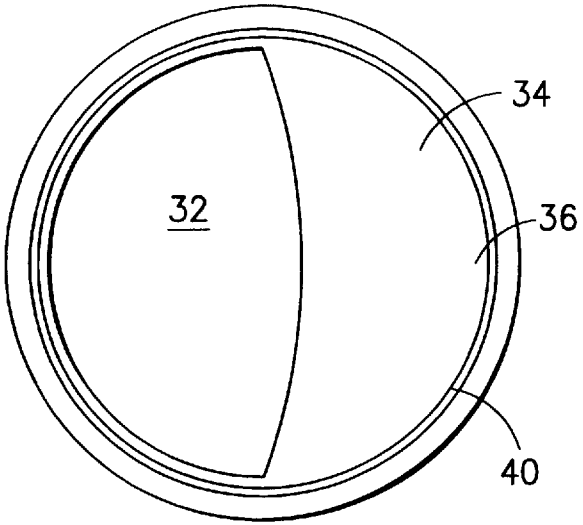
FIG. 10 is a top plan view of the lens of FIG. 9.

The screw cap 28 has a half-moon shaped opening or window 30, FIGS. 6 and 7, in which there is mounted a lens 32 of a liner member 34, FIGS. 9 and 10.

The liner member 34 has underside sealing areas 36 which are engageable with the lip of the neck portion 22 of the jar liner 18, to provide a hermetic seal therewith.

Referring to FIG. 2, in carrying out the sealing function, the periphery or peripheral wall 22 of the liner 18 is provided with an upstanding bead 38 which is engageable with the under-surface of the liner member 34, and the latter has an annular sharp bead 40 which is engageable with the inside of the rim or lip of the wall 22 of the liner 18. The result is an essentially completely air-tight or hermetic sealing engagement with the jar lip and wall 22. The sealing pressure from the closure cap 28 is transmitted to the lens-liner member 34 as the cap is screwed down tightly on the wall 22, as will now be understood. Advantageously, the liner 18 can be constituted of yieldable polyolefin plastic.

With the closure screw cap being constituted of the two ultrasonically joined pieces 28 and 34, as noted, according to the invention the actual sealing occurs solely between the lens or liner piece 34 and the jar lip or wall 22, with the periphery of the screw cap 28 lying radially outside of the sealing area and as such, not participating in the sealing function except to retain the pressure on the liner piece 34.

The transparent lens 32 not only facilitates inspection of the container contents, but in addition the member 34 having the lens is solely responsible for the seal with the jar lip 22. As noted, the seal is accomplished between solely two molded components, each of which is integral in and of itself and thus air-tight, namely the liner 18 and the lens-liner 34. The opaque characteristic of the screw cap 28 has a distinct advantage from the aesthetics standpoint, since it fully conceals the thread 24 of the jar wall 22 as well as concealing its own internal thread 26. In accomplishing the concealment, the peripheral portion of the screw cap 28 extends radially inwardly of the wall 22, such that the said peripheral portion, being opaque, hides the cooperable threads 24, 26 even if the pot is viewed from above and where the viewer looks through the transparent lens 32 at an angle. All that is visible is the product itself (not shown), and the inner surfaces of the side wall 22 of the liner 18.

Figure 4:
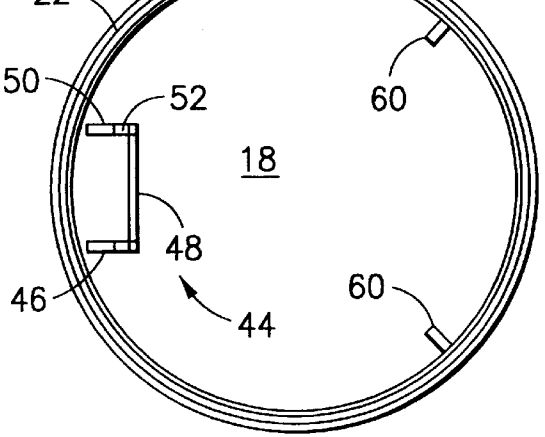
FIG. 4 is a top plan view of the inner component of the container.
Figure 5:
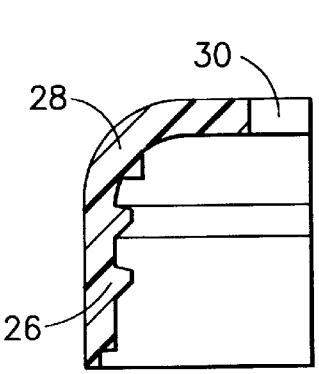
FIG. 5 is a fragmentary section, greatly enlarged, of the peripheral portion of the closure cap part of the pot.
Figure 3:
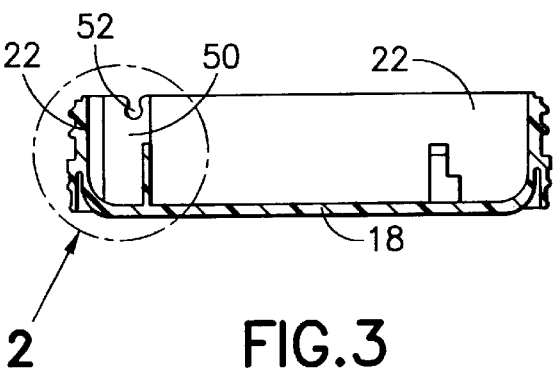
FIG. 3 is an axial section of the inner component or liner of the container of FIG. 1.
Figure 8:
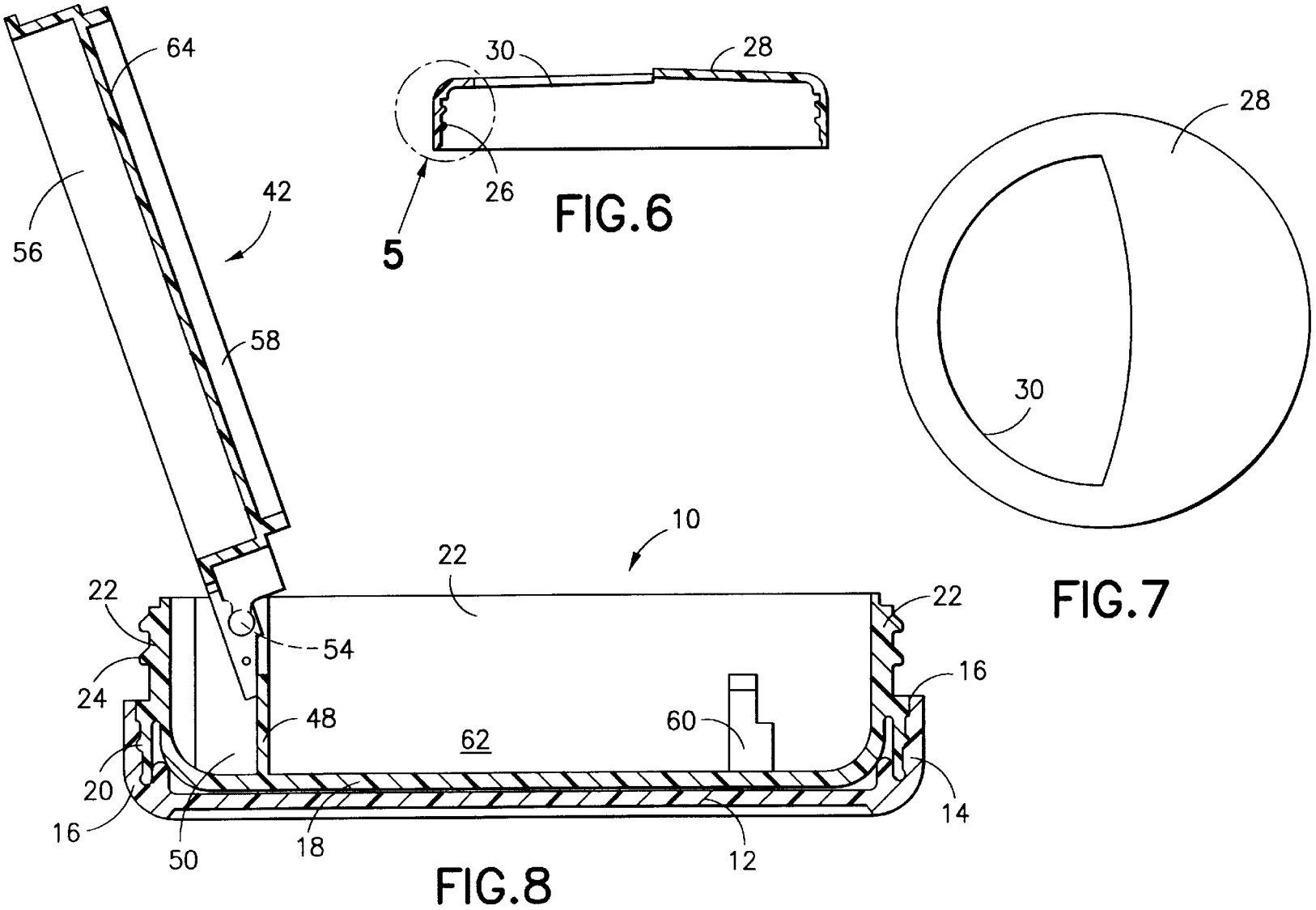
FIG. 8 is an axial sectional view of the pot, with the closure cap part removed and with the swivel tray in its open position.
Figure 14:
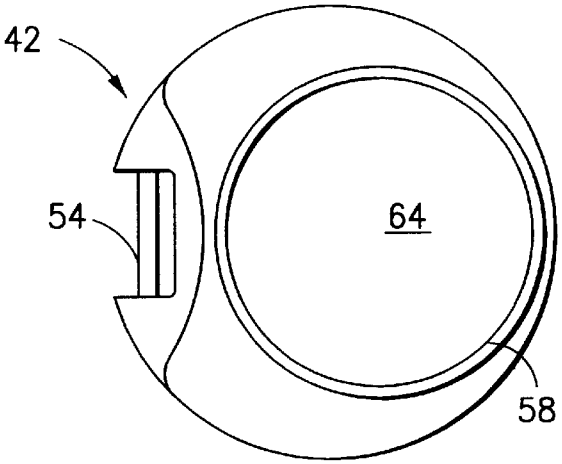
FIG. 14 is a top plan view of the platform member of FIG. 13.
Figure 15:
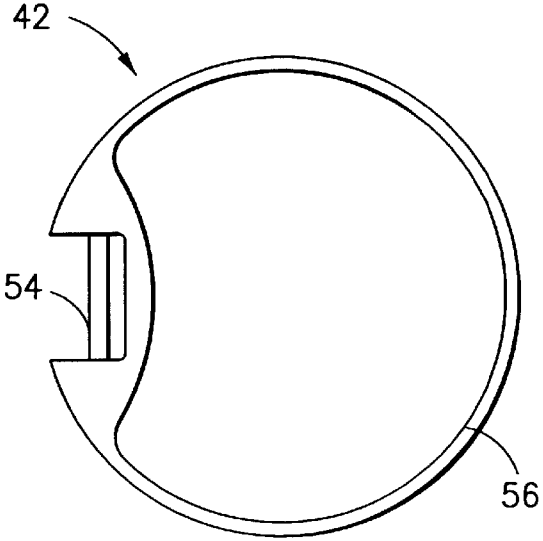
FIG. 15 is a bottom plan view of the platform member of FIGS. 13 and 14.
Figure 13:
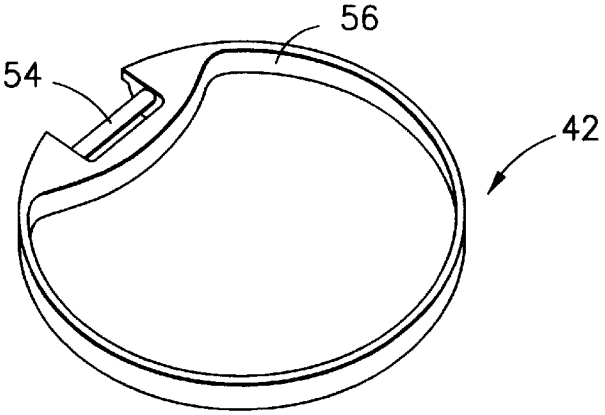
FIG. 13 is a perspective view of a platform member for incorporation in the pot, as provided by the invention.

According to the present invention, in conjunction with the above structures there is provided a unique swivel-type circular platform 42 within the upper portion of the liner 18. Referring to FIGS. 3 and 4, the liner 18 has an upstanding yieldable trunnion mounting 44 comprising walls 46, 48 and 50. The walls 46 and 50 constitute saddles and have notches 52 to accept the pintle 54 of the platform 42 (FIGS. 13–15). The platform 42 has an upstanding peripheral flange 56 to enable it to function as a shallow tray for cosmetic product (not shown), and has on its under side a circular flange 58 to provide support when it is folded and disposed within the pot. For this latter purpose, the liner 18 has a pair of resilient shoulders or support portions 60 (FIG. 8).

Figure 12:
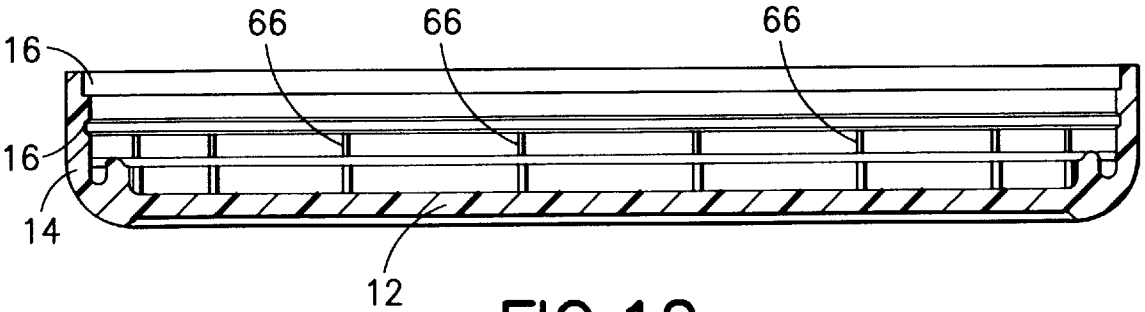
FIG. 12 is an axial section of the outer container component of the pot.
Figure 11:
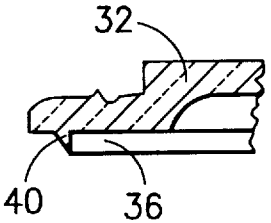
FIG. 11 is a fragmentary section, greatly enlarged, of the peripheral portion of the lens of FIG. 9 shown by the broken circle in this figure.

As shown in FIG. 1, a space 62 exists beneath the platform 42, to store an applicator such as a powder puff (not shown) or the like. The underside 64 of the platform 42 can be constituted as a mirror surface, for use when the cosmetic is to be applied by the user. In FIG. 12 the outer jacket 12 is shown as having a plurality of vertical friction ribs 66 which are forcibly engageable with the exterior of the liner 18 to prevent incidental rotation of the latter.

From the above it can be seen that we have provided a novel and improved display-type applicator-containing pot or compact which is both simple in its structure, and which features improved seal characteristics that are confined essentially to the container lip, and solely inner parts of the composite pot assemblage, namely the inner liner portions thereof. Conventional cap liners of the type which have been employed in the past, are not required. Where the upper liner is made transparent, the contents of the container can be readily viewed; also, where the screw cap member is constituted of opaque plastic, all the threads of the container are completely concealed from view, this latter feature being considered very important from the commercial standpoint.

An exemplar variation constitutes a completely opaque closure with the applicator occupying the top level of the inner chamber atop the swivel platform or tray, and the product storage occupying the space beneath the swivel platform or tray. The bottom of the platform or tray serves as the mirror-reflecting surface when the platform or tray swings up to its utility position.

As an alternative, the screw cap member can be a solid, opaque, one-piece design, having the desired air-tight characteristics. Also, the cosmetic product can occupy either the tray or the bottom wall area of liner 18. Similarly, an applicator or puff can occupy one of either the tray or the bottom wall area of liner 18.

As a further alternative, the platform 42 can be a hinge design or other type of design, such as a simple stacking design.

The disclosed structure is thus seen to represent a distinct advance and improvement in the dispenser field.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A display-type applicator-containing compact for cosmetics, comprising, in combination:

a) a shallow jar having a wide neck portion provided with external screw threads, said neck portion having at its rim a continuous sealing lip, b) a screw cap member that is cooperable with said neck portion, said cap member having internal screw threads that engage the external screw threads of the neck portion, and having a window in its top, c) a plastic liner member disposed under the screw cap member, said liner member having sealing portions which are engageable with the sealing lip of said neck portion and with the underside of the cap member, d) said liner member having a lens portion which occupies the window of the screw cap to permit a user to see the interior of the jar, and e) a swivel tray pivotally mounted in the jar and swingable up and out of the jar when the screw cap is removed, f) said tray being adapted to hold cosmetic material which can be viewed through the lens portion of the liner member.

2. A display-type applicator-containing compact as set forth in claim 1, wherein:

a) said jar comprises an inner container member and an outer jacket which surrounds the lower portions of said container member, b) said jacket and container member being constituted of dissimilar plastic materials which have different physical yieldability characteristics.

3. A display-type applicator-containing compact as set forth in claim 2, wherein:

a) said screw cap member and outer jacket have substantially aligned peripheral walls.

4. A display-type applicator-containing compact as set forth in claim 2, wherein:

a) said container member has means providing a swivel saddle which is cooperable with the said swivel tray to provide a pivotal mounting therefor.

5. A display-type applicator-containing compact as set forth in claim 4, wherein:

a) the swivel tray has a trunnion which is laterally receivable in the said swivel saddle.

6. A display-type applicator-containing compact as set forth in claim 4, wherein:

a) the swivel tray can be opened to a fixed angle for the convenience of use.

7. A display-type applicator-containing compact as set forth in claim 2, wherein:

a) said inner container member and said liner member are constituted of a polyolefin.

8. A display-type applicator-containing compact as set forth in claim 2, wherein:

a) said container member has means providing a resilient support for the said swivel tray when the latter is disposed in the container member.

9. A display-type applicator-containing compact as set forth in claim 8, wherein:

a) the said resilient support means for the swivel tray comprises upstanding shoulders in the container member, in the form of thin-section walls.

10. A display-type applicator-containing compact as set forth in claim 1, wherein:

a) said screw cap member has a window-like opening in its top surface, and b) said plastic liner member has a transparent window spanning the said window opening.

11. A display-type applicator-containing compact as set forth in claim 1, wherein:

a) said swivel tray has a peripheral top flange to provide a barrier for confining the cosmetics, and has a bottom circular flange to provide a support surface when the tray is in the container member.

12. A display-type applicator-containing compact as set forth in claim 11, wherein: a) the swivel tray has a mirror means disposed within the said bottom circular flange.

13. A display-type applicator-containing compact for cosmetics and the like comprising, in combination:

a) a shallow jar having a wide neck portion provided with external screw threads, and having an annular exterior shoulder below said neck portion, said neck portion having at its rim a continuous sealing lip, b) a screw cap member that is cooperable with said neck portion, said cap member having internal screw threads that engage the external screw threads of the neck portion, c) an outer jacket surrounding the lower portions of said jar, said outer jacket having a top rim which is flush with the annular shoulder of said jar, d) said jar and outer jacket being constituted of dissimilar plastic materials which have different yieldability characteristics, and e) said jacket being permanently and interlockingly press-fitted over said jar and being frictionally seized thereby.

14. A display-type applicator-containing compact as set forth in claim 13, wherein:

a) said shallow jar and outer jacket have interlocking means comprising annular ribs and grooves receiving the ribs, to maintain the jacket in place on the shallow jar.

15. A display-type applicator-containing compact as set forth in claim 13, wherein:

a) said shallow jar has a depending skirt which is disposed within said outer jacket, b) said depending skirt being integral with said jar.

16. A display-type applicator-containing compact for cosmetics comprising, in combination:

a) a shallow jar having a wide neck portion provided with external screw threads, and having an annular exterior shoulder below said neck portion, said neck portion having at its rim a continuous sealing lip, b) a screw cap member that is cooperable with said neck portion, said screw cap member having internal screw threads that engage the external screw threads of the neck portion, c) an outer jacket surrounding the lower portions of said jar, said outer jacket having a top rim which is flush with the annular shoulder of said jar, d) said jar and outer jacket being constituted of dissimilar plastic materials which have different yieldability characteristics, e) said jacket being permanently and interlockingly press-fitted over said jar and being frictionally seized thereby, f) said shallow jar and outer jacket having interlocking means comprising annular ribs and grooves receiving the ribs, to maintain the jacket in place on the shallow jar, said shallow jar having a depending skirt which engages the inner surface of the jacket under compression, g) said depending skirt being connected to the shallow jar by a thin, resilient web.

17. A display-type applicator-containing compact for cosmetics comprising, in combination:

a) a shallow jar having a wide neck portion provided with external screw threads, said neck portion having at its rim a continuous sealing lip, b) a screw cap member that is cooperable with said neck portion, said cap member having internal screw threads that engage the external screw threads of the neck portion, c) an outer jacket surrounding the lower portions of said jar, d) said jar and outer jacket being constituted of dissimilar plastic materials which have different yieldability characteristics, e) a swivel tray pivotally mounted in said shallow jar, f) said jacket being press-fitted over said jar, g) said shallow jar having resilient support means for positioning said swivel tray, h) said resilient support means comprising upstanding shoulders in the shallow jar, said shoulders comprising thin section walls.

18. A display-type applicator-containing compact comprising, in combination:

a) a shallow jar having a wide neck portion provided with external screw threads, said neck portion having at its rim a continuous sealing lip, b) a screw cap member that is cooperable with said neck portion, said screw cap member having internal screw threads that engage the external screw threads of the neck portion, c) an outer jacket surrounding the lower portions of said jar, d) said jar and outer jacket being constituted of dissimilar plastic materials which have different yieldability characteristics, e) a swivel tray disposed in said jar, f) said jacket being press-fitted over said jar, g) said jar having stops for engagement with said swivel tray, h) said stops comprising thin-section walls.

* * * * *